US010223980B2

(12) United States Patent
Luo et al.

(10) Patent No.: US 10,223,980 B2
(45) Date of Patent: Mar. 5, 2019

(54) DISPLAY DEVICE AND DISPLAY METHOD

(71) Applicant: HISENSE ELECTRIC CO., LTD., Qingdao (CN)

(72) Inventors: Junyu Luo, Qingdao (CN); Mingtao Liu, Qingdao (CN); Shengfeng Hong, Qingdao (CN); Mingsheng Qiao, Qingdao (CN)

(73) Assignees: HISENSE ELECTRIC CO., LTD., Qingdao (CN); HISENSE USA CORPORATION, Suwanee, GA (US); HISENSE INTERNATIONAL CO., LTD., Qingdao (CN)

( * ) Notice: Subject to any disclaimer, the term of this patent is extended or adjusted under 35 U.S.C. 154(b) by 0 days.

(21) Appl. No.: 15/393,669

(22) Filed: Dec. 29, 2016

(65) Prior Publication Data

US 2017/0110066 A1 Apr. 20, 2017

(30) Foreign Application Priority Data

Sep. 9, 2016 (CN) ..... 2016 1 0814771

(51) Int. Cl.
*G09G 3/36* (2006.01)
*G09G 3/34* (2006.01)

(52) U.S. Cl.
CPC ..... *G09G 3/3406* (2013.01); *G09G 3/36* (2013.01); *G09G 2310/08* (2013.01); *G09G 2320/062* (2013.01); *G09G 2320/0646* (2013.01)

(58) Field of Classification Search
CPC .... G09G 3/3406; G09G 3/36; G09G 2310/08; G09G 2320/062; G09G 2320/064; G09G 2320/0646; G02F 1/133602; G02F 1/133603
See application file for complete search history.

(56) References Cited

U.S. PATENT DOCUMENTS

2008/0143757 A1* 6/2008 Furihata ..... G09G 3/3406 345/690
2015/0310809 A1* 10/2015 Ryu ..... G09G 3/342 345/691
2016/0005368 A1* 1/2016 Park ..... G09G 3/3614 345/209
2016/0358561 A1* 12/2016 Chen ..... G09G 3/36
2018/0048853 A1* 2/2018 Koh ..... G09G 3/2092

* cited by examiner

*Primary Examiner* — Xuemei Zheng
(74) *Attorney, Agent, or Firm* — Harness, Dickey & Pierce, P.L.C.

(57) ABSTRACT

Disclosed is a display device comprising: at least one processor and a memory, wherein the memory stores therein computer readable instructions, wherein the at least one processor executes the computer readable instructions to: if an input image signal is received, adjust refresh frequency of the display device to the frequency of the input image signal, and generate an output image signal and a field sync signal according to the input image signal, wherein the filed sync signal and the input image signal are in sync with each other and have the same frequency; output a backlight driving signal at a rising edge of the field sync signal acting as a trigger edge, so that backlighting of the display device is synchronized with image display of the display device; and perform the image display according to the output image signal and provide the backlighting according to the backlight driving signal.

15 Claims, 3 Drawing Sheets

DISPLAY DEVICE AND DISPLAY METHOD

CROSS-REFERENCE TO RELATED APPLICATION

This application claims benefit and priority of Chinese Patent Application No. 201610814771.3 filed Sep. 9, 2016. The entire disclosure of the above application is incorporated herein by reference.

FIELD

The present disclosure relates to the field of display technology, and particularly to a display device. The present disclosure also relates to a display method

BACKGROUND

This section provides background information related to the present disclosure which is not necessarily prior art.

A display device, a device which displays information output by a computer or an image signal output device, also called a display, is a human-machine interface device. It could transform signals input by a computer or an image signal output device into various text, number, symbol or intuitive images and display the images.

For a conventional display device, its image display parameters have been set at the factory and generally its image display parameters will not be changed. Therefore, a display device could only perform normal image output for an image signal which fits with the display device. And hence a computer or an image signal output device needs to communicate with a display device, after obtaining the EDID (Extended Display Identification Data) information of the display device, it outputs an image signal according to the display parameters of the display device to adapt the computer to the display device.

SUMMARY

This section provides a general summary of the disclosure, and is not a comprehensive disclosure of its full scope or all of its features.

Some embodiments of the present disclosure provide a display device, the device includes:

an image processor configured to, if an input image signal is received, adjust a refresh frequency of the display device to a frequency of the input image signal, and generate an output image signal and a field sync signal according to the output image signal, wherein the field sync signal and the output image signal are in sync with each other and have the same frequency; there is a time delay between the input image signal and the output image signal;

a backlight synchronization processor configured to output a backlight driving signal at a rising edge of the field sync signal acting as a trigger edge, so that backlighting of the display device is synchronized with the image display of the display device; and a display configured to perform the image display according to the output image signal and provide the backlighting according to the backlight driving signal.

Some embodiments of the present disclosure provide another display device, the device includes:

at least one processor and a memory, wherein the memory stores computer readable instructions, wherein the at least one processor executes the computer readable instructions to:

if an input image signal is received, adjust a refresh frequency of the display device to frequency of the input image signal, and generate an output image signal and a field sync signal according to the input image signal, wherein the field sync signal and the output image signal are in sync with each other and have the same frequency; there is a time delay between the input image signal and the output image signal;

output a backlight driving signal at a rising edge of the field sync signal acting as a trigger edge, so that backlighting of the display device is synchronized with the image display of the display device; and perform the image display according to the output image signal and provide the backlighting according to the backlight driving signal.

Some embodiments of the present disclosure provide an image display method, the method includes:

if an input image signal is received, adjusting a refresh frequency of the display device to frequency of the input image signal, and generating an output image signal and a field sync signal according to the input image signal, wherein the field sync signal and the output image signal are in sync with each other and have the same frequency; there is a time delay between the input image signal and the output image signal;

outputting a backlight driving signal at a rising edge of the field sync signal acting as a trigger edge, so that backlighting of the display device is synchronized with the image display of the display device; and performing the image display according to the output image signal and providing the backlighting according to the backlight driving signal.

Further aspects and areas of applicability will become apparent from the description provided herein. It should be understood that various aspects of this disclosure may be implemented individually or in combination with one or more other aspects. It should also be understood that the description and specific examples herein are intended for purposes of illustration only and are not intended to limit the scope of the present disclosure.

DRAWINGS

The drawings described herein are for illustrative purpose only of selected embodiments and not all possible implementations, and are not intended to limit the scope of the present disclosure.

Corresponding reference numerals indicate corresponding parts or features throughout the several views of the drawings.

DETAILED DESCRIPTION

Figure 1:
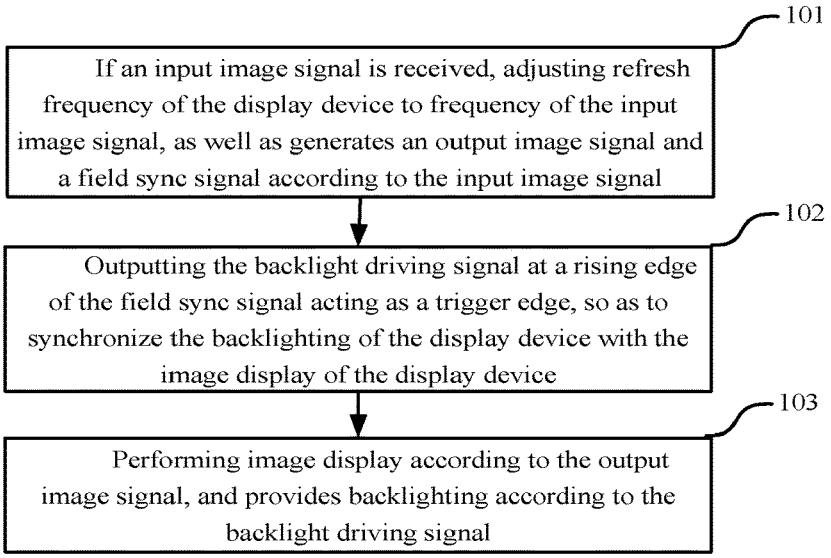
FIG. 1 is a schematic flow chart of a display method according to the present disclosure.

Example embodiments will now be described more fully with reference to the accompanying drawings.

As described in "BACKGROUND", for a conventional display device, its image display parameters have been set at the factory and generally its image display parameters will not be changed. Therefore, if a display device receives an image signal which does not match the display device, it would not be able to output a normal image, resulting in unsmooth or flickering for image. In a display device, there are different reasons for a stuck screen and a flickering screen.

If a display device receives an input image signal, it needs to transform the input image signal into an output image signal to drive image display. When performing image display, the display device needs to keep the frequency of the output image signal consistent with refresh frequency of the display device. Therefore, if the frequency of the input image signal is different from the refresh frequency of the display device, the number of frames (frequency) of the output image signal generated by the display device would be different from the number of frames (frequency) of the input image signal. The display device needs to increase or decrease the number of frames when transforming the input image signal into the output image signal, thereby distorting the image signal and causing image unsmooth. For example, when the frequency of the input image signal output by an image signal output device is 50 Hz, and the frequency of the display device's output image signal is 60 Hz, the display device needs to add extra 10 frames of images, which is prone to cause a motion image displayed by the display screen to be unsmooth.

When a display device is performing image display, it needs to adjust the brightness of the image by backlighting, and if the backlighting of the display device is not synchronized with its image display, its screen would flicker. For example, if backlight driving frequency of the display device is 120 Hz, frequency of the output image signal thereof is 50 Hz, a user would sense the screen flickering when he/she watches the display device or a camera equipment shooting the display device.

Therefore, to solve the problem that when a display device is outputting an image, displayed image gets unsmooth and flickering, the present disclosure provides an image display method: the display device adjusts its display parameters according to its received image signal, so that the number of frames (frequency) of its output image signal is the same with the number of frames (frequency) of its input image signal, as well as its image display is synchronized with its backlighting, thereby display the image normally.

It needs to be explained that the solutions of the present disclosure is applied to dynamic backlight controlled display devices, such as a liquid crystal display television with dynamic backlight control. According to embodiments of the present disclosure, refresh frequency of the display device could be adaptive to frequency of the input image signal, therefore backlight switch frequency of the display device should also be adaptive to the changes of the refresh frequency.

Based on the discussions above, the schematic flow chart of an image display method according to the present disclosure is illustrated by FIG. 1, the method includes the following operations.

S101: if an input image signal is received, a display device adjusts its refresh frequency to the frequency of the input image signal, and generates an output image signal and a field sync signal according to the input image signal.

According to embodiments of the present disclosure, if the display device receives an input image signal, it first adjusts its refresh frequency to the frequency of the input image signal.

The refresh frequency of display device is the frequency with which its screen displays images. For a display device, the frequency of the output image signal needs to be the same with the refresh frequency so that the display device could perform normal image display. Therefore, when the frequency of the input image signal is different from the refresh frequency of display device, to ensure that the frequency of the output image signal is the same with the refresh frequency, the display device needs to generate an output image signal whose frequency is different from the input image signal. If the generated frequency of the output image signal is greater than the frequency of the input image signal, it means the display device needs to add extra frames. Moreover, the number of these extra frames is calculated on the basis of the input image signal by the display device, and there might be problems such as the calculation might be inaccurate, so image signal of these extra frames might be inaccurate, which causes the displayed image to be unsmooth. If the generated frequency of the output image signal is smaller than the frequency of the input image signal, then it means a certain number of frames needs to be removed, which would distort the image signal and also causes the displayed image to be unsmooth. Obviously, either increasing the number of frames or decreasing the number of frames is prone to cause inaccuracy of the output image signal and cause the displayed image to be unsmooth.

Therefore, in order to solve the abovementioned problem of the displayed image getting unsmooth, according to embodiments of the present disclosure, the display device adjusts its refresh frequency to the frequency of the input image signal, now the frequency of the output image signal generated by the display device is the same with the frequency of the input image signal, and thus avoiding adding extra frame or removing frames, guaranteeing the accuracy for signal during the image signal transformation, thereby solving the problem of unsmooth image.

According to some embodiments of the present disclosure, the adjustment of the refresh frequency could be performed by the following operations.

(1) Obtaining the frequency of the input image signal.

If the display device receives the input image signal, it performs signal processing on the input image signal to obtain frequency of the input image signal.

(2) Judging whether or not refresh frequency of the display device is the same as the frequency of the input image signal.

After obtaining the frequency of the input image signal, the display device judges whether or not its refresh frequency is the same as the frequency of the input image signal.

(3) If yes, keeping the refresh frequency unchanged.

If it is the same, then it means that the current frequency of the output image signal generated by the display device is the same as the input signal frequency, and there is no need to add extra frames or remove any frames, neither would cause displayed image to be unsmooth, so the refresh frequency does not need to be adjusted.

(4) If not, adjust the refresh frequency to the frequency of the input image signal.

If it is not the same, then it means that the current frequency of the output image signal generated by the display device is different from the input signal frequency, the number of frames needs to be increased or decreased, prone to cause displayed image to be unsmooth. Therefore the refresh frequency needs to be adjusted.

By the abovementioned adjustment of the refresh frequency, the frequency of the output image signal generated by the display device is the same as the frequency of the input image signal, and thus avoiding adding extra frame or removing frames, guaranteeing accuracy for signal during the image signal transformation, thereby solving the problem of unsmooth image.

The abovementioned process is an adaptation of display device for the image signal, through which the display device could be automatically self-adaptive to signals of different frequencies, the refresh frequency which can be displayed by the display device is widened, and the problem is solved in that a conventional display device could only display a signal that fits with the display device, and displayed image would be unsmooth when displaying an image signal which does not fit with the display device.

It needs to be explained that, abovementioned method for adjusting the refresh frequency is just one implementation method proposed by the present disclosure, and based on the idea of the present disclosure, those skilled in the art could adopt other method of adjustment, which would not affect the scope of protection of the present disclosure.

Moreover, according to some embodiments of the present disclosure, when the display device is generating the output image signal, it is also generating a field sync signal. The field sync signal is configured to adjust backlight synchronization, and is a benchmark for the backlight synchronization. Therefore, when generating a field sync signal, the display device needs to keep the field sync signal in sync with the output image signal, as well as keep the field sync signal frequency the same as the frequency of the output image signal.

In an aspect, for a display device, its backlighting is driven by a backlight driving signal. According to embodiments of the present disclosure, the backlight driving signal is generated with the field sync signal as the benchmark. Therefore, only when the field sync signal is kept in sync with the input image signal, a reference benchmark synchronized with the signal phase of output image could be provided for the generation of the backlight driving signal, so that the backlighting driven by the backlight driving signal could be synchronized with the image display driven by the output image signal.

In another aspect, according to some embodiments of the present disclosure, backlight switch frequency should be an integral multiple of the frequency of the output image signal, and the backlight switch frequency is the same as the signal frequency of backlight driving, therefore, the signal frequency of backlight driving is also an integral multiple of the frequency of the output image signal.

As can been seen in the above description, according to embodiments of the present disclosure, the refresh frequency of the display device is adaptive to the input signal frequency, so when the input signal frequency is relatively small, the refresh frequency and backlight switch frequency of the display device would be decreased accordingly. When the backlight switch frequency of the display device is relatively small, it brings about a problem of backlight switch flickering, which would be described in detail below.

According to embodiments of the present disclosure, in order to avoid the flicker phenomenon due to large backlight reflection interval, the signal frequency of backlight driving is adjusted to an integral multiple of the frequency of the output image signal, in order to improve the backlight switch frequency, thereby solving the switch flickering problem due to low frequency of the input image signal.

According to some embodiments of the present disclosure, the field sync signal could further provide a reference benchmark frequency to the backlight driving signal. Because the field sync signal frequency is the same as the frequency of the output image signal, therefore when the backlight driving signal is produced, it only needs to ensure that the signal frequency of backlight driving is an integral multiple of the field sync signal frequency to ensure that the backlight driving signal frequency is an integral multiple of the frequency of the output image signal.

According to some embodiments of the present disclosure, in order to synchronize the field sync signal with the output image signal, the rising edge of the field sync signal (representing the beginning of a cycle) in a same cycle is synchronized with the start bit of the output image signal, and the falling edge of the field sync signal (representing the end of a cycle) in a same cycle is synchronized with the end bit of the output image signal. This method could ensure that the field sync signal is in sync with the output image signal in every circle.

By performing Operation S101, the display device could be adaptive to different input image signals, so as to keep frequency of the output image signal generated by itself the same as the frequency of the input image signal. When the image is being displayed, every frame could be displayed normally and would not be unsmooth.

The display device further generates a field sync signal in sync with the output image signal, which provides important reference benchmark for the following synchronization of the backlighting and the image display.

S102: the display device outputs the backlight driving signal at a rising edge of the field sync signal acting as a trigger edge, so as to synchronize the backlighting of the display device with the image display of the display device.

By performing Operation S101, the refresh frequency of display device could be adaptive to the input signal, therefore if frequency of the input image signal is changing, refresh frequency of the display device is changing continuously as well. For a display device, its backlighting and image display needs to be synchronized to prevent backlight flicker. Therefore, if the refresh frequency of display device is changed, its backlight switch frequency thereof needs to be changed accordingly, to as to match the refresh frequency.

Generally, the backlighting of the display device is produced by backlight unit, which is driven by the backlight driving signal. However, a high voltage and a high current are used for backlight driving, so during the driving process, there would be a certain problem of backlight driving delay comparing with the processing of the display signal. That is, for the backlight unit, there tends to be a certain time delay from receiving the backlight driving signal to generating a backlight to illuminate the display screen. In embodiments of the present disclosure, the above-described time delay is referred to as delay time for backlight driving.

The delay time for backlight driving can be measured. According to embodiments of the present disclosure, the delay time for backlight driving of the display device is measured to be used as an important parameter for adjusting backlight synchronization.

According to embodiments of the present disclosure, in order to achieve synchronization between backlighting and image display of the display device, it is necessary not only to use the field sync signal as a benchmark for synchronous reference, but also to consider the influence of the delay time for backlight driving on backlighting synchronization.

Therefore, when the backlight driving signal is being generated by the display device, a rising edge of the field sync signal (representing the beginning of a cycle) is used as a trigger edge of the backlight driving signal, and at the same time, because the backlight driving tends to delay, the backlight driving signal is generated after a preset time, which is just the difference between the cycle of the backlight driving signal and the backlight driving delay. This enables the time when the backlight driving signal arrives in advance to be equal to the delay time for backlight driving, so that the backlight generated by the display device is synchronized with the image display, thereby solving the problem of displayed image flickering in the display device.

It should be noted that in the display device, the backlight driving signal is applied to the backlight unit to generate the backlight. Therefore, the frequency (cycle) of the backlight driving signal is the same as the backlight dimming frequency (cycle) of the backlight unit.

In addition, for the display device, the backlight dimming frequency is an integral multiple of the frequency of the input image signal. This relationship shows that the signal frequency of backlight driving is also an integral multiple of the input signal frequency and the field sync signal frequency.

In some embodiments of the present disclosure, the backlight driving signal is generated by using the field sync signal frequency as the reference bench. When the backlight driving signal is being generated, it is necessary to ensure that the signal frequency of backlight driving is an integral multiple of the field sync signal frequency, thereby ensuring that the signal frequency of backlight driving is an integral multiple of the frequency of the input image signal so as to achieve a better backlighting effect.

According to the method for adjusting backlight driving frequency, the display device can automatically convert the signal frequency of backlight driving, to achieve the adaptive match effect of the signal frequency of backlight driving, the problem is solved that the backlight driving signal can only match a single output image signal, and the image output capability and the output image quality of the display device are improved.

In some embodiments of the present disclosure, the backlight driving signal could be a pulse width modulated (PWM) signal. The duty cycle of the PWM signal could be preset or adjusted by the user in real time. The greater the duty cycle is, the greater the brightness provided by the backlight unit, and the smaller the duty cycle is, the smaller the brightness provided by the backlight unit.

It should be noted that, while the PWM signal is adjusting the backlight brightness through its duty cycle, current in the backlight unit is not changed, so that color temperature of the light produced by the back unit is not changed, and the color of the display screen is more accurate, the display quality of the display device is improved, and the viewing experience of the user is improved.

In another aspect, when the light emitted from the backlight unit shines on the display screen, there would be a small amount of reflection, which is easy to be observed and would affect the viewing experience of the user, if the frequency of the backlighting is low. Therefore, according to embodiments of the present disclosure, the frequency of the PWM signal is an integral multiple of the frequency of the field sync signal, and the frequency of the backlighting is accelerated by the method of frequency-doubled backlighting. As the frequency increases, it is difficult for the user to perceive the reflected light, thereby improving the display quality of the display device and enhancing the viewing experience of the user.

It should be noted that the selection of a PWM signal as the backlight driving signal is only the scheme used in some embodiments of the present disclosure. Other types of signals may be used as the backlight driving signal based on the idea of the present disclosure, which will not affect the scope of protection of the present disclosure.

According to some embodiments of the present disclosure, S102 could be implemented by the following signal generation method.

Optionally, the operations of the signal generation method are as follows.

(1) Selecting a reference cycle in the field sync signal.

In the generation of the backlight driving signal, first it is necessary to select a reference cycle in the field sync signal.

(2) Obtaining a first time point corresponding to a rising edge of the reference cycle.

A rising edge of the reference cycle refers to the start position of the reference cycle. When the backlight driving signal is being generated, the backlight driving signal is output at a trigger edge as which a rising edge of the reference cycle acts. Therefore, a first time point corresponding to the rising edge of the reference period needs to be obtained.

(3) Using a second time point after the first time point as a starting point to output the PWM signal. The time interval between the first time point and the second time point equals to difference between the cycle of the PWM signal and delay time for backlight driving.

After the first time point corresponding to the rising edge of the reference cycle is obtained, the backlight driving signal is not directly output at the time point. For the backlight unit in the display device, there is a certain delay time for backlight driving from receiving the backlight drive signal to generating the backlight illuminating display screen. Therefore, when the backlight driving signal is being generated, the influence of the delay time for backlight driving needs to be eliminated.

In some embodiments of the present disclosure, the pulse width modulated (PWM) signal is output in the reference cycle after the first time point at the second time point which is the starting point. And the time interval between the first time point and the second time point is equal to difference between the cycle of the PWM signal and the delay time for backlight driving.

The backlight driving signal generated by the above-described method causes the time when the backlight driving signal arrives earlier equals to the delay time for backlight driving, therefore the frequency at which the backlight is actually turned on could be just synchronized with the field sync signal (exactly one cycle later), and the field sync signal is synchronized with the output image signal, so that the backlighting driven by the adjusted backlight driving signal is synchronized with the image display, to solve the problem of backlight flicker and to improve the display quality of the display device.

By the above-mentioned backlighting synchronization method, the display device achieves adaptive match of the backlighting to the image display, thereby solving the drawback that the backlighting of the display device can only match a single output image signal, widening the adaptive match scope of the display device backlighting, improving the display device display quality, and enhancing the user's viewing experience.

It should be noted that the above-described method of generating the backlight driving signal is only an alternative according to the present disclosure and that other methods of generation may also be employed by those skilled in the art based on the conception of the present disclosure without affecting the scope of protection of the present disclosure.

Through S102, the backlight driving signal generated by the display device could eliminate the influence of the backlighting delay generated at the backlight unit on the image display, so that the backlighting driven by the backlight driving signal is synchronized with the image display.

S103: The display device performs image display according to the output image signal, and provides backlighting according to the backlight driving signal.

The adjustment of S101 enables the display device to automatically adjust its refresh frequency according to the frequency of the input image signal, so that its image display is adaptively matched to the input image signal. The frequency of the output image signal generated by the display device and the frequency of the input image signal could be made uniform. Therefore, when the display device drives image display by the output image signal, displayed image would not be unsmooth.

The adjustment of S102 enables the display device to automatically adjust its own backlight driving signal in accordance with the output image signal, so that the display device backlighting is adaptively matched to different output image signals. The backlighting driven by the backlight driving signal could be synchronized with the image display of the display device. Therefore, when the display device drives image display by the output image signal, displayed image would not be unsmooth.

As described above, when an input image signal is received, the display device first adjusts its refresh frequency to the frequency of the input image signal and generates a synchronous field sync signal while generating an output image signal. Then, the display device uses a rising edge of the field sync signal as a trigger edge to output a backlight driving signal, so as to synchronize its backlighting with the image display. The frequency of the output image signal generated by the display device is the same as the frequency of the input image signal because the refresh frequency of the display device is the same as the frequency of the input image signal. Moreover, since the backlighting of the display device is synchronized with its image display, there would be no flicker during the image display, solving the problem of unsmooth and flickering image when the display device is performing the image display.

Figure 2:
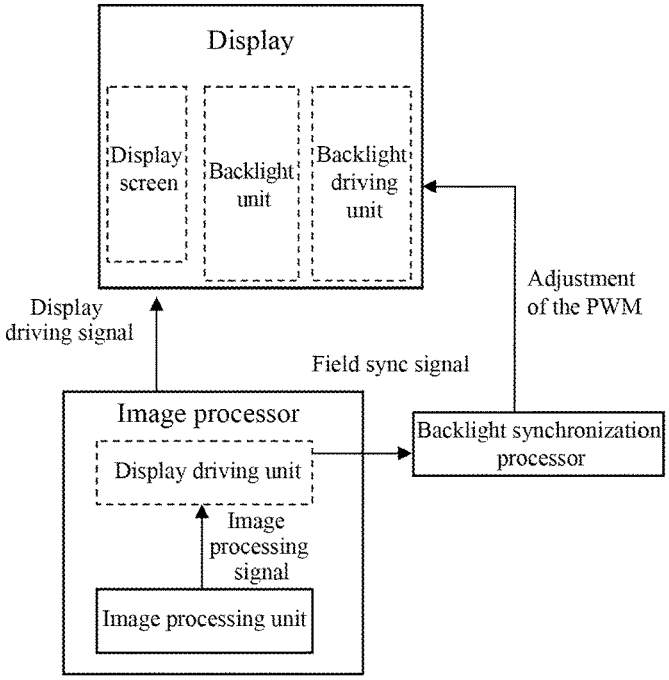
FIG. 2 is a structural schematic diagram of a display device according to some embodiments of the present disclosure.

In order to further explain the technical idea of the present disclosure, the technical solution of the present disclosure will be described with reference to a configuration of the display device as shown in FIG. 2. The display device includes a display, an image processor, and a backlight synchronization processor. First, the display device will be described as follows.

According to some embodiments, the display includes a display screen, a backlight unit, and a backlight driving unit, where:

The display screen is configured to display an image to a user according to a certain frame frequency on the basis of an image signal inputted from the outside, whereby the user could obtain an intuitive viewing effect, and according to some embodiments, the vertical frequency of the display screen, also known as the refresh frequency, is $V_f$, where $V_f$ supports multiple frequencies.

The backlight unit provides a backlight for the display, which is controlled by the backlight driving unit. The backlight switching frequency is called dimming frequency, which should be an integral multiple of refresh frequency of the display screen.

The backlight driving unit is configured to drive the backlight unit, so that the backlight unit could emit light to provide backlighting for the display screen. It enables the backlight driving unit to adjust brightness of the backlight unit so as to adjust the image brightness of the display screen, by adjusting a PWM signal input to the backlight driving unit to adjust the driving current parameter of the backlight driving unit, where the PWM dimming frequency is the same as dimming frequency of the backlight.

Between the input time of PWM signal and the time when a backlight LED is actually emitting light, there is a certain time delay, which is called backlight driving delay and could be obtained by measurement.

The backlight synchronization processor receives a field sync signal provided by the display driving unit and outputs the PWM signal (backlight driving signal) to the backlight driving unit with a rising edge of the field sync signal as a trigger edge, where duty cycle of the PWM signal can be preset or adjusted by the user in real time, and the greater the duty cycle is, the greater the brightness provided by the backlight unit.

The image processor includes an image processing unit and a display driving unit.

The image processing unit could receive an image signal inputted by an image signal output device and transmit the received image signal to the display driving unit. The image processing unit can recognize the clock information of the input image signal and obtain the display cycle $T_{in}$ of each frame of image.

The display driving unit receives the image signal processed by the image processing unit and then drives the display screen to display the image. The display driving unit generates a field sync signal while outputting the image signal, where the field sync signal has a same frequency as the output image signal and the field sync signal is synchronized with the output image signal. That is, the rising edge of the field sync signal in each cycle is synchronized with the image start bit of each field, and the falling edge of the field sync signal in each cycle is synchronized with the image end bit of each field.

There may be a delay due to frame buffering or other reasons, i.e., the display driving image signal will be later than the input image signal for a certain time.

Based on the above description of the internal structure of the display device, the image display flow of the present disclosure may include the following operations:

Case 1: The frame frequency of the input image signal is the same as the refresh frequency preset by the display device.

(1) When the display device powers up and starts to work, the image processing unit transmits the image signal to the display driving unit in accordance with the preset image content; the display driving unit processes the image signal output by the image processing unit and outputs an image signal capable of driving the display screen to perform image display to the display screen.

(2) The display driving unit generates a field sync signal while outputting the image signal, where the field synchronizing signal has the same frequency as the output image signal and is synchronized with the output image signal. That is, the rising edge of the field sync signal in each cycle is synchronized with the image start bit of each field, and the falling edge of the field sync signal in each cycle is synchronized with the image end bit of each field.

(3) The backlight synchronization processor receives the field sync signal provided by the display driving unit, and outputs the PWM signal to the backlight driving unit with a rising edge of the field sync signal as a trigger edge.

(4) The backlight synchronization processor detects the first rising edge of the field sync signal to be the triggered PWM signal, and then adjusts the PWM signal after the time of $T_{out1}-\Delta T_P$, where the time node is taken as the starting node of the adjusted PWM signal to re-output the adjusted PWM signal. $T_{out1}$ is a cycle of the PWM signal and $\Delta T_P$ is the delay time for backlight driving.

Considering the fact that there is a time delay of $\Delta T_P$ between the backlight actually emitting light and the PWM signal, it is necessary to adjust the PWM signal.

With the abovementioned method, the display device could implement the synchronization of the input image frequency, the display frequency and the backlight frequency after the operations, thereby reducing unsmooth and flickering phenomena of displayed image.

Case 2: The frame frequency of the input image signal is not the same as the refresh frequency preset by the display device.

(1) The image processing unit receives the input image signal from the image signal output device, and performs image processing on the input image signal and obtains signal frequency of the input image signal.

(2) If the frequency of the input image signal and the refresh frequency are not equal, the display driving unit performs field-frequency adjustment processing on the image signal output by the image processing unit, makes the frequency of the input image signal equal to the refresh frequency, and outputs an image signal capable of driving the display screen to perform image display to the display screen.

(3) The display driving unit generates the field sync signal while outputting the image signal, where the frequency of the field sync signal is the same as the frequency of the adjusted output image signal and the field sync signal is synchronized with the adjusted output image signal.

(4) The backlight synchronization processor receives the field sync signal provided by the display driving unit and outputs the PWM signal to the backlight drive unit with a rising edge of the field sync signal as a trigger edge.

(5) After the time of $T_{out2}-\Delta T_P$, adjusting the PWM signal, where the time node is taken as the starting node of the adjusted PWM signal to re-output the adjusted PWM signal. $T_{out2}$ is a cycle of the adjusted PWM signal and $\Delta T_P$ is the delay time for backlight driving.

Considering the fact that there is a time delay of $\Delta T_P$ between the backlight actually emitting light and the PWM signal, it is necessary to adjust the PWM signal.

With the abovementioned method, the display device could implement the synchronization of the input image frequency, the display frequency and the backlight frequency, thereby reducing unsmooth and flickering phenomena of displayed image.

Figure 3:
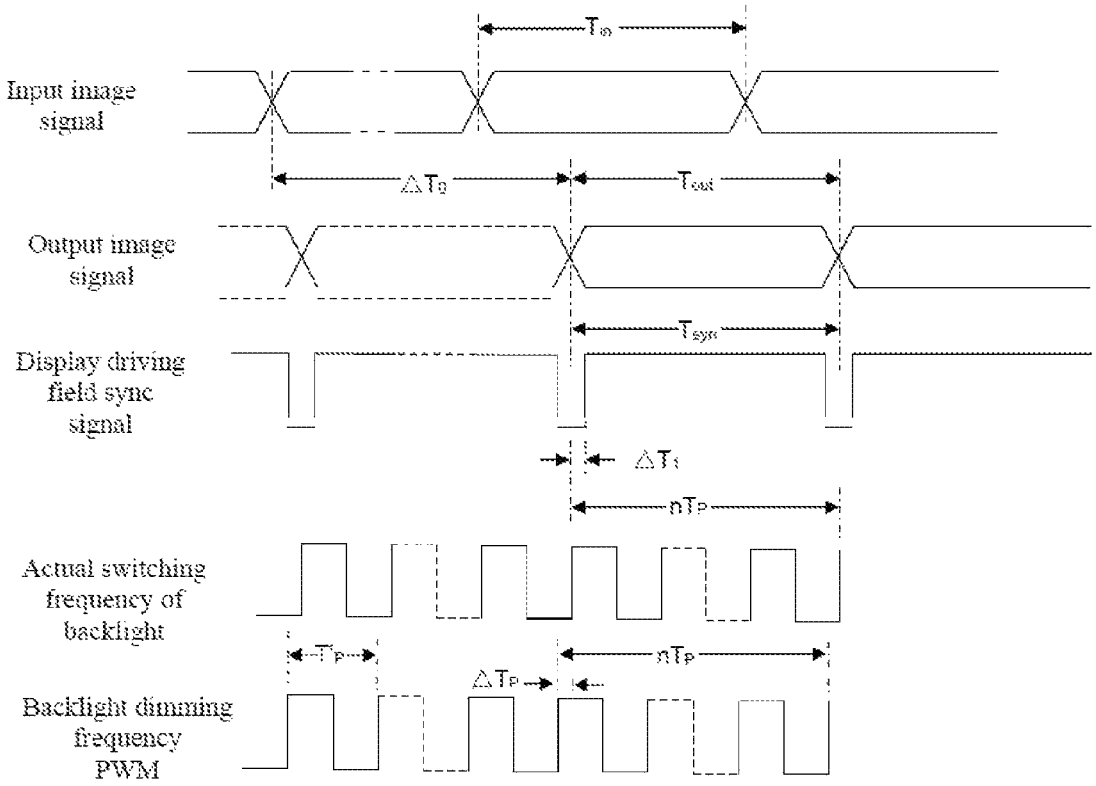
FIG. 3 is a schematic diagram of different signals' relationships according to some embodiments of the present disclosure.

Moreover, as shown in FIG. 3, there is a schematic diagram of different signal relationships according to some embodiments of the present disclosure.

As can be seen from the figure, the signals involved in this disclosure include an input image signal, a display driving image signal, a display driving field sync signal, a backlight dimming PWM signal, and a t actual switching frequency of backlight.

The display cycles of the input image signal, the display driving image signal and the display driving field sync signal are the same, and the display driving image signal is synchronized with the display driving field sync signal.

There is a time delay of ΔTP between the backlight driving signal and the display driving field sync signal, and the actual switching frequency of backlight, the display driving image signal and the display driving field sync signal are synchronized with each other.

Figure 4:
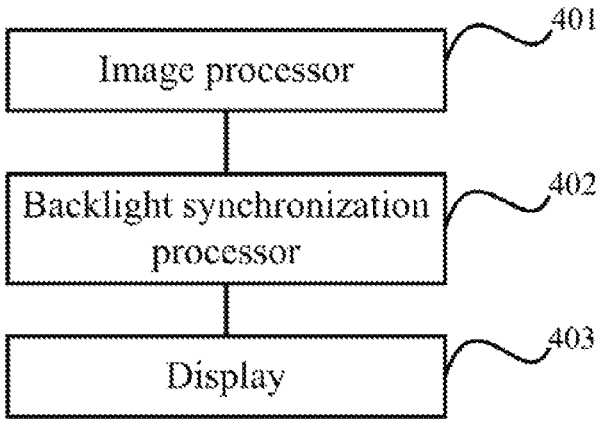
FIG. 4 is a structural schematic diagram of a display device according to the present disclosure.

The present disclosure proposed a display device, as illustrated by FIG. 4, the device comprises:

an image processor 401 configured to, if an input image signal is received, adjust a refresh frequency to the frequency of the input image signal, as well as generate an output image signal and a field sync signal according to the input image signal, where the field sync signal is in sync with the input image signal and both signals have the same frequency;

a backlight synchronization processor 402 configured to output a backlight driving signal at a rising edge of the field sync signal acting as a trigger edge, so that backlighting of the display device is synchronized with image display of the display device; and a display 403 configured to perform the image display according to the output image signal and provide backlighting according to the backlight driving signal.

According to some embodiments, the rising edge of the field sync signal in a same cycle is synchronized with the start bit of the output image signal, and the falling edge of the field sync signal in a same cycle is synchronized with the end bit of the output image signal.

In some embodiments, the backlight driving signal is a pulse width modulated (PWM) signal, and the backlight synchronization processor is configured to:

select a reference cycle in the field sync signal;

obtain a first time point corresponding to a rising edge of the reference cycle;

use a second time point after the first time point as a starting point to output the PWM signal, where time interval between the first time point and the second time point equals to difference between the cycle of the PWM signal and the delay time for backlight driving.

According to some embodiments of the disclosure, the image processor is configured to:

obtain the frequency of the input image signal;

judge whether or not the refresh frequency of display device is the same as the frequency of the input image signal;

if yes, keep the refresh frequency unchanged; and if not, adjust the refresh frequency to the frequency of the input image signal.

According to some embodiments, the PWM signal frequency is an integral multiple of the frequency of the input image signal.

The disclosure further provides a display device, the device includes: at least one processor and a memory, where the memory stores computer readable instructions, where the at least one processor executes the computer readable instructions to:

if an input image signal is received, adjust refresh frequency of the display device to the frequency of the input image signal, as well as generate an output image signal and a field sync signal according to the input image signal, where the field sync signal the input image signal are in sync with each other and have the same frequency;

output a backlight driving signal at a rising edge of the field sync signal acting as a trigger edge, so that backlighting of the display device is synchronized with image display of the display device; and perform the image display according to the output image signal and provide the backlighting according to the backlight driving signal.

According to some embodiments, the at least one processor executes the computer readable instructions to make the rising edge of the field sync signal in a same cycle be synchronized with the start bit of the output image signal, and the falling edge of the field sync signal in a same cycle be synchronized with the end bit of the output image signal.

According to some embodiments, the at least one processor executes the computer readable instructions to:

acting a pulse width modulated (PWM) signal as the backlight driving signal;

select a reference cycle in the field sync signal;

obtain a first time point corresponding to a rising edge of the reference cycle;

use a second time point after the first time point as a starting point to output the PWM signal, where time interval between the first time point and the second time point equals to difference between the cycle of the PWM signal and the delay time for backlight driving.

According to some embodiments, the at least one processor executes the computer readable instructions to adjust refresh frequency of the display device to the frequency of the input image signal, sby:

obtaining the frequency of the input image signal;

judging whether or not refresh frequency of the display device is the same as the frequency of the input image signal;

if yes, keeping the refresh frequency unchanged; and if not, adjusting the refresh frequency to the frequency of the input image signal.

According to some embodiments, the at least one processor executes the computer readable instructions so that the PWM signal frequency is an integral multiple of the frequency of the input image signal.

Figure 5:
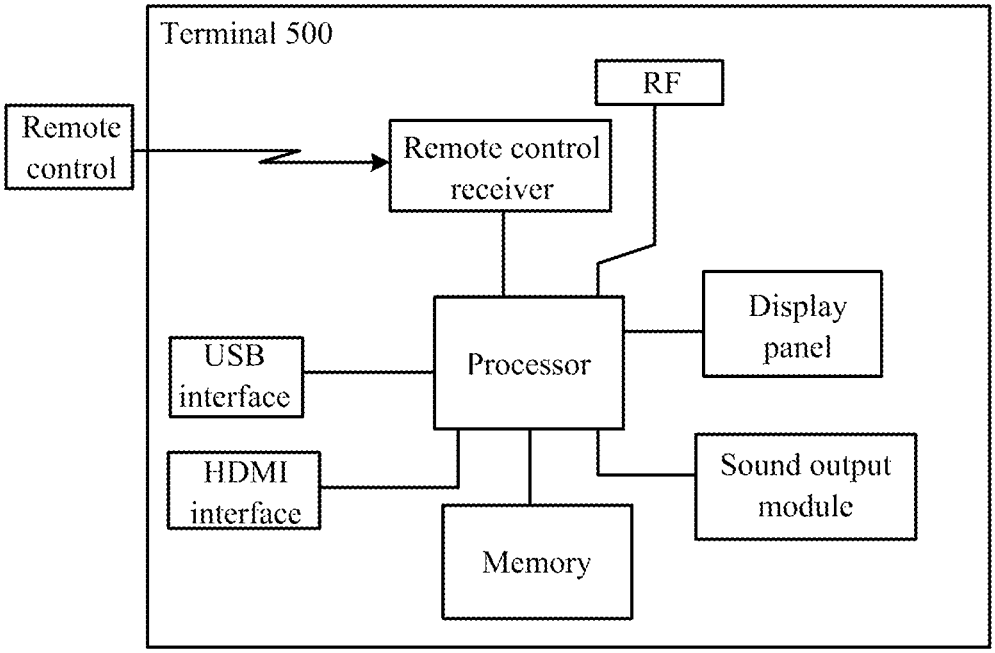
FIG. 5 is a structural schematic diagram of a terminal according to the present disclosure.

The present disclosure further provides a terminal 500. As illustrated in FIG. 5, the terminal 500 could include components such as a storage, an input unit, an output unit, and one or more processors. Those skilled in the art could understand that the structure of the terminal 500 in the embodiments is not limited to the structure as illustrated in FIG. 5, and the terminal may include more or fewer components, combine certain components or be configured with different components, where:

the memory could be configured to store software programs and modules. The processor executes various functional applications and data processing by running the software programs and modules stored in the memory. The memory could include a high-speed random-access memory or a non-volatile memory such as at least one magnetic disk storage device, flash memory device or another nonvolatile solid state storage device. In addition, the memory could further include a memory controller, to provide the processor and the input unit with access to the memory.

The processor is the controlling center of the terminal 500, which is connected with the respective parts of the terminal by various interfaces and circuits, by running or executing programs or/and modules stored in the memory, executes various functions of the terminal 500 and processes data by retrieving data stored in the memory, thereby monitoring the overall terminal 500. Optionally, the processor could include one or more processing cores. The processor could be integrated with an application processor and a modulation and demodulation processor, where the application processor primarily manages the operating system, user interface, applications and etc., and the modulation and demodulation processor primarily manage wireless communications. It could be understood that it is also possible that the modulation and demodulation processor are not integrated into the processor.

The terminal 500 could include an input unit such as a TV broadcast receiver, a high-definition multimedia interface, a USB interface, an audio and video input structure, where the input unit could further include a remote control receiver that receives a signal from a remote control. In addition, the input unit could further include a touch sensitive surface or another input device, where there are a variety of technologies with different methods of sensing touch, such as resistive touch, capacitive touch, infra touch, surface acoustic wave touch and so on, the other devices could include but are not limited to one or more of a physical keyboard, a function key like a volume control push button, a switch key and so forth, a trackball, a mouse, an operating lever and so on.

The output unit is configured to output sound signals, video signals, warning signals, vibration signals and so on. The output unit could include a display panel, a sound output module and so on. The display panel could be configured to display information input by a user, information provided for a user and various graphic user interfaces of the terminal 500, which could be constituted by graphics, texts, icons, videos and any of their combinations. For example, the display panel could be a Liquid Crystal Display (LCD)

After reading the descriptions of embodiments above, those ordinarily skilled in the art can clear understand that the disclosure could be realized by hardware, or by software plus a necessary common hardware platform. Based on such an understanding, the technical solutions of the disclosure could adopt the form of a software product which could be stored in a non-volatile storage medium (which may be a CD-ROM, a USB disk, a removable hard disk, etc.) and includes instructions for enabling a computer device (which may be a personal computer, server, or network device, etc.) to perform the methods described in the various embodiments of the present disclosure.

It will be understood by those skilled in the art that a drawings is merely a schematic diagram of one embodiment, and that the blocks or processes in the drawings are not necessarily essential to the practice of the disclosure.

The foregoing description of the embodiments has been provided for purposes of illustration and description. It is not intended to be exhaustive or to limit the disclosure. Individual elements or features of a particular embodiment are generally not limited to hat particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A display device, comprising:

an image processor configured to, when an input image signal is received, adjust a refresh frequency of the display device to a frequency of the input image signal, and generate an output image signal and a field sync signal according to the input image signal, wherein the field sync signal and the output image signal are in sync with each other and have the same frequency, and there is a time delay between receiving the input image signal and generating the output image signal;

a backlight synchronization processor configured to output a backlight driving signal at a rising edge of the field sync signal that acts as a trigger edge, so backlighting of the display device is synchronized with an image display of the display device; and a display configured to display an image according to the output image signal and provide the backlighting according to the backlight driving signal;

wherein the rising edge of the field sync signal in a cycle is synchronized with a start bit of the output image signal corresponding to the same cycle, and a falling edge of the field sync signal in the same cycle is synchronized with an end bit of the output image signal corresponding to the same cycle.

2. The display device according to claim 1, wherein the backlight driving signal is a pulse width modulated (PWM) signal, and the backlight synchronization processor is further configured to:

select a reference cycle in the field sync signal;

obtain a first time point between a latest falling edge before the reference cycle and a current rising edge of the reference cycle; and use a second time point after the first time point as a starting point to output the PWM signal, wherein a time interval between the first time point and the second time point equals a difference between a cycle of the PWM signal and a delay time for backlight driving, and the delay time for backlight driving is equal to a difference between a rising edge of the PWM signal and a time point of lighting a backlight by the rising edge of the PWM signal.

3. The display device according to claim 2, wherein a frequency of the PWM signal is an integral multiple of a frequency of the output image signal.

4. The display device according to claim 1, wherein the backlight driving signal is a pulse width modulated (PWM) signal, and the backlight synchronization processor is further configured to:

select a reference cycle in the field sync signal;

obtain a first time between a latest falling edge before the reference cycle and a current rising edge of the reference cycle; and use a second time point after the first time point as a starting point to output the PWM signal, wherein a time interval between the first time point and the second time point equals a difference between a cycle of the PWM signal and a delay time for backlight driving, and the delay time for backlight driving is equal to a difference between a rising edge of the PWM signal and a time point of lighting a backlight by the rising edge of the PWM signal.

5. The display device according to claim 1, wherein the image processor is further configured to:

obtain the frequency of the input image signal;

judge whether the refresh frequency of the display device is the same as the frequency of the input image signal;

when the refresh frequency of the display device is the same as the frequency of the input image signal, keep the refresh frequency unchanged; and when the refresh frequency of the display device is not the same as the frequency of the input image signal, adjust the refresh frequency to the frequency of the input image signal.

6. A display device, comprising:

at least one processor; and a memory, wherein the memory stores computer readable instructions, and the at least one processor executes the computer readable instructions to:

when an input image signal is received, adjust a refresh frequency of the display device to a frequency of the input image signal, and generate an output image signal and a field sync signal according to the input image signal, wherein the field sync signal and the output image signal are in sync with each other and have the same frequency, and there is a time delay between receiving the input image signal and generating the output image signal;

output a backlight driving signal at a rising edge of the field sync that acts as a trigger edge, so backlighting of the display device is synchronized with an image display of the display device;

display an image according to the output image signal and provide the backlighting according to the backlight driving signal; and synchronize the rising edge of the field sync signal in a cycle with a start bit of the output image signal corresponding to the same cycle, and synchronize a falling edge of the field sync signal in the same cycle with an end bit of the output image signal corresponding to the same signal.

7. The display device according to claim 6, wherein the at least one processor executes the computer readable instructions to:

output the backlight driving signal as a pulse width modulated (PWM) signal;

select a reference cycle in the field sync signal;

obtain a first time point between a latest falling edge before the reference cycle and a current rising edge of the reference cycle; and use a second time point after the first time point as a starting point to output the PWM signal, wherein a time interval between the first time point and the second time point equals a difference between a cycle of the PWM signal and a delay time for backlight driving, and the delay time for backlight driving is equal to a difference between a rising edge of the PWM signal and a time point of lighting a backlight by the rising edge of the PWM signal.

8. The display device according to claim 7, wherein a frequency of the PWM signal is an integral multiple of a frequency of the output image signal.

9. The display device according to claim 6, wherein the at least one processor executes the computer readable instructions to:

output the backlight driving signal as a pulse width modulated (PWM) signal;

select a reference cycle in the field sync signal;

obtain a first time point between a latest falling edge before the reference cycle and a current rising edge of the reference cycle; and use a second time point after the first time point as a starting point to output the PWM signal, wherein a time interval between the first time point and the second time point equals a difference between a cycle of the PWM signal and a delay time for backlight driving, and the delay time for backlight driving is equal to a difference between a rising edge of the PWM signal and a time point of lighting a backlight by the rising edge of the PWM signal.

10. The display device according to claim 6, wherein the at least one processor executes the computer readable instructions to adjust a refresh frequency of the display device to the frequency of the input image signal, by:

obtaining the frequency of the input image signal;

judging whether the refresh frequency of the display device is the same as the frequency of the input image signal;

when the refresh frequency of the display device is the same as the frequency of the input image signal, keeping the refresh frequency unchanged; and when the refresh frequency of the display device is not the same as the frequency of the input image signal, adjusting the refresh frequency to the frequency of the input image signal.

11. An image display method, comprising:

when an input image signal is received, adjusting a refresh frequency of the display device to a frequency of the input image signal, and generating an output image signal and a field sync signal according to the input image signal, wherein the field sync signal and the output image signal are in sync with each other and have the same frequency, and there is a time delay between receiving the input image signal and generating the output image signal;

outputting a backlight driving signal at a rising edge of the field sync signal that acts as a trigger edge, so backlighting of the display device is synchronized with an image display of the display device; and displaying an image according to the output image signal and providing the backlighting according to the backlight driving signal;

wherein the rising edge of the field sync signal in a cycle is synchronized with a start bit of the output image signal corresponding to the same cycle, and a falling edge of the field sync signal in the same cycle is synchronized with an end bit of the output image signal corresponding to the same cycle.

12. The method according to claim 11, wherein the backlight driving signal is a pulse width modulated (PWM) signal, and outputting a backlight driving signal at a rising edge of the field sync signal that acts as a trigger edge comprises:

selecting a reference cycle in the field sync signal;

obtaining a first time point between a latest falling edge before the reference cycle and a current rising edge of the reference cycle; and using a second time point after the first time point as a starting point to output the PWM signal, wherein a time interval between the first time point and the second time point equals a difference between a cycle of the PWM signal and a delay time for backlight driving, and the delay time for backlight driving is equal to a difference between a rising edge of the PWM signal and a time point of lighting a backlight by the rising edge of the PWM signal.

13. The method according to claim 12, wherein a frequency of the PWM signal is an integral multiple of a frequency of the output image signal.

14. The method according to claim 11, wherein the backlight driving signal is a pulse width modulated (PWM) signal, and outputting a backlight driving signal at a rising edge of the field sync signal that acts as a trigger edge comprises:

selecting a reference cycle in the field sync signal;

obtaining a first time point between a latest falling edge before the reference cycle and a current rising edge of the reference cycle; and using a second time point after the first time point as a starting point to output the PWM signal, wherein a time interval between the first time point and the second time point equals a difference between a cycle of the PWM signal and a delay time for backlight driving, and the delay time for backlight driving is equal to a difference between a rising edge of the PWM signal and a time point of lighting a backlight by the rising edge of the PWM signal.

15. The method according to claim 11, wherein adjusting the refresh frequency of the display device to the frequency of the input image signal comprises:

obtaining the frequency of the input image signal;

judging whether the refresh frequency of display device is the same as the frequency of the input image signal;

when the refresh frequency of the display device is the same as the frequency of the input image signal, keeping the refresh frequency unchanged; and when the refresh frequency of the display device is not the same as the frequency of the input image signal, adjusting the refresh frequency to the frequency of the input image signal.

* * * * *